US011473281B1

(12) United States Patent
Lee et al.

(10) Patent No.: US 11,473,281 B1
(45) Date of Patent: Oct. 18, 2022

(54) DRAIN GUARD FOR GARBAGE DISPOSAL

(71) Applicants: Timothy Joseph Lee, Fairfield, CA (US); Michael Breuer Graham, Basking Ridge, NJ (US)

(72) Inventors: Timothy Joseph Lee, Fairfield, CA (US); Michael Breuer Graham, Basking Ridge, NJ (US)

(73) Assignee: ENSU DESIGN, LLC, Sheridan, WY (US)

( * ) Notice: Subject to any disclaimer, the term of this patent is extended or adjusted under 35 U.S.C. 154(b) by 0 days.

(21) Appl. No.: 17/327,215

(22) Filed: May 21, 2021

(51) Int. Cl.
*E03C 1/26* (2006.01)
*E03C 1/266* (2006.01)

(52) U.S. Cl.
CPC ..... *E03C 1/26* (2013.01); *E03C 1/2665* (2013.01)

(58) Field of Classification Search
CPC ..... E03C 1/26
USPC ..... 4/629, 619, 630–631; 134/115; 210/348; 241/46.013, 68
See application file for complete search history.

(56) References Cited

U.S. PATENT DOCUMENTS 2,795,330 A * 6/1957 Sawyer ..... F16P 1/02 241/46.016
3,161,360 A * 12/1964 Levine ..... E03C 1/2665 241/46.016
4,089,474 A * 5/1978 Timmer ..... E03C 1/2665 241/46.016
4,188,674 A * 2/1980 Mardirosian ..... E03C 1/26 4/292
4,253,616 A * 3/1981 Timmer ..... E03C 1/2665 241/46.016
4,519,102 A * 5/1985 Efstratis ..... E03C 1/26 241/46.016
4,752,035 A * 6/1988 Felder ..... E03C 1/2665 241/46.016
5,271,108 A * 12/1993 Wicke ..... E03C 1/26 4/292
5,473,782 A * 12/1995 Coakley ..... A47L 17/02 4/295
7,480,954 B1 1/2009 Houck
7,533,836 B2 * 5/2009 Pan ..... E03C 1/2665 241/46.016
7,740,197 B1 6/2010 Schulz
7,967,225 B1 * 6/2011 Schulz ..... E03C 1/266 241/46.016
2006/0272080 A1 * 12/2006 Walsh ..... A47K 1/14 4/295
2007/0152087 A1 * 7/2007 Pan ..... E03C 1/2665 241/46.016
2008/0072387 A1 * 3/2008 Dombrowski ..... E03C 1/26 4/286
2009/0094766 A1 * 4/2009 Dombrowski ..... E03C 1/126 15/105
2014/0223651 A1 * 8/2014 Melheim ..... E03C 1/126 4/222

(Continued)

*Primary Examiner* — Lori L Baker

(57) ABSTRACT

A drain guard for a sink equipped with a garbage disposal, the drain guard having a support ring and at least two interior surfaces extending inward and terminating internal of the support ring. The interior surfaces may have free edges that are laterally proximate but separated by a vertical distance to allow for the passage of food waste but prevent utensils and other objects from entering the garbage disposal.

20 Claims, 9 Drawing Sheets

(56) References Cited

U.S. PATENT DOCUMENTS

| | | | | |
|---|---|---|---|---|
| 2015/0218786 | A1* | 8/2015 | Cullen | A46B 15/00 4/628 |
| 2016/0194856 | A1* | 7/2016 | Melheim | E03D 9/00 4/222 |
| 2021/0395986 | A1* | 12/2021 | Ahuja | E03C 1/262 |

* cited by examiner

DRAIN GUARD FOR GARBAGE DISPOSAL

BACKGROUND—PRIOR ART

The following is a tabulation of some prior art that presently appears relevant:

| U.S. Patents | | | |
|---|---|---|---|
| Pat. No. | Kind Code | Issue Date | Patentee |
| 3,161,360 | A | 1964 Dec. 15 | Levine |
| 4,089,474 | A | 1978 May 16 | Timmer |
| 4,253,616 | A | 1981 Mar. 03 | Timmer |
| 7,480,954 | B1 | 2009 Jan. 27 | Houck |
| 7,740,197 | B1 | 2010 Jun. 22 | Schulz |
| 7,967,225 | B1 | 2011 Jun. 28 | Schulz |

Many kitchen sinks are equipped with garbage disposals, also known as food waste disposers. These devices are useful for grinding up food waste that is washed away from cookware, dishware, and utensils and for flushing the ground up waste down the drain. However, although a garbage disposal is designed to handle most food waste, utensils and other objects can inadvertently fall into the drain unnoticed and can get mangled or destroyed by the blades of the garbage disposal, which in some cases can damage the garbage disposal itself. Also, since a garbage disposal drain is deep and covered by a baffle, it can sometimes be difficult to see if a utensil has fallen in.

While a sink strainer or drain guard can be used with a garbage disposal, many users dislike using them because they trap food waste and periodically need to be cleaned out in order to ensure that water and other liquids can continue to drain out of the sink; this typically requires users to handle the strainer and the trapped food waste and subsequently wash their hands to ensure that any bacteria from the waste is cleaned off. Additionally, most sink strainers prevent all but the smallest food particles from passing through, which leaves the garbage disposal underutilized for its intended purpose. Therefore, some users choose not to use a strainer for their garbage disposal drain and to accept the risks associated with utensils and other objects inadvertently falling in.

In U.S. Pat. No. 3,161,360 (1964), Levine discloses a drain guard for use with sinks equipped with garbage disposals, where the drain guard is placed inside of the drain across the opening of the garbage disposal. The drain guard comprises a circular disk with a plurality of openings that allow water to flow through but prevents silverware and other objects from entering the garbage disposal.

In U.S. Pat. No. 4,089,474 (1978) and 4,253,616 (1981), Trimmer discloses drain protectors for use with garbage disposals, where the drain guard comprises a circular disk that is pivotally mounted towards the side of the garbage disposal wall. The drain protector allows smaller food particles to pass around the guard or through an opening in the guard, but it prevents utensils and other objects from entering the garbage disposal. The drain protector can also be swung downward to allow the passage of larger food particles into the garbage disposal.

In U.S. Pat. No. 7,480,954 (2009), Houck discloses a garbage disposal tool for scraping and stuffing food waste into the garbage disposal. The tool can also be inserted into the garbage disposal drain and provides flutes or channels that allow small food waste particles to pass through while preventing utensils and other objects from entering the garbage disposal.

In U.S. Pat. No. 7,740,197 (2010) and 7,967,225 (2011), Schulz discloses guards for use with garbage disposals, where the guard is placed inside of the drain at the inlet of the garbage disposal. The drain guards comprise an outer tubular ring and a grate that allow small food waste particles to pass through while preventing utensils and other objects from entering the garbage disposal.

While functional for allowing smaller food waste particles to pass through while preventing most utensils and other objects from entering the garbage disposal, the prior-art devices have many disadvantages. Particularly, the inventors believe that the prior-art devices that have small openings or channels (Levine, Trimmer, and Houck) may only allow for smaller food waste particles to pass through and may leave larger food particles trapped, which may accumulate and block the flow of water or other liquids down the drain. Additionally, these devices may also require the user to remove or otherwise physically interact with the devices in order to clean out the larger trapped food particles. The inventors also believe that these devices cannot effectively be sized or configured to allow larger food particles to easily pass through without also allowing utensils and other objects to enter the garbage disposal.

The inventors also believe that the prior-art devices that have hinges (Trimmer) or multiple parts (Houck) may be more difficult to clean and are more susceptible to having small food particles and other contaminants get trapped in the part interfaces, which may cause mold and foul odors to develop over time. The inventors also believe that such devices may be more expensive to manufacture than simpler devices.

While devices with larger grate openings (Schulz) for food waste particles to pass through exist, the inventors believe that narrower utensils such as knives and chopsticks may easily pass through and enter the garbage disposal. While the grate openings may be adjusted to prevent such utensils from passing through, the inventors believe that the smaller openings may end up trapping larger food particles and may require more frequent cleaning.

What is needed is a simple garbage disposal drain guard that allows a larger range of food particle sizes to easily pass though while effectively preventing utensils and other objects from entering the garbage disposal.

SUMMARY OF THE INVENTION

In accordance with one embodiment, a drain guard for a sink equipped with a garbage disposal, the drain guard comprising a support ring and a plurality of interior surfaces extending inward from the support ring, wherein the surfaces terminate internal of the support ring and have free edges that are in close lateral proximity but are generally separated by a vertical distance such that food waste particles can pass through but utensils are prevented from entering the garbage disposal. Other embodiments are described and shown.

DRAWINGS—FIGURES

DRAWINGS-REFERENCE NUMERALS

Figure 1:
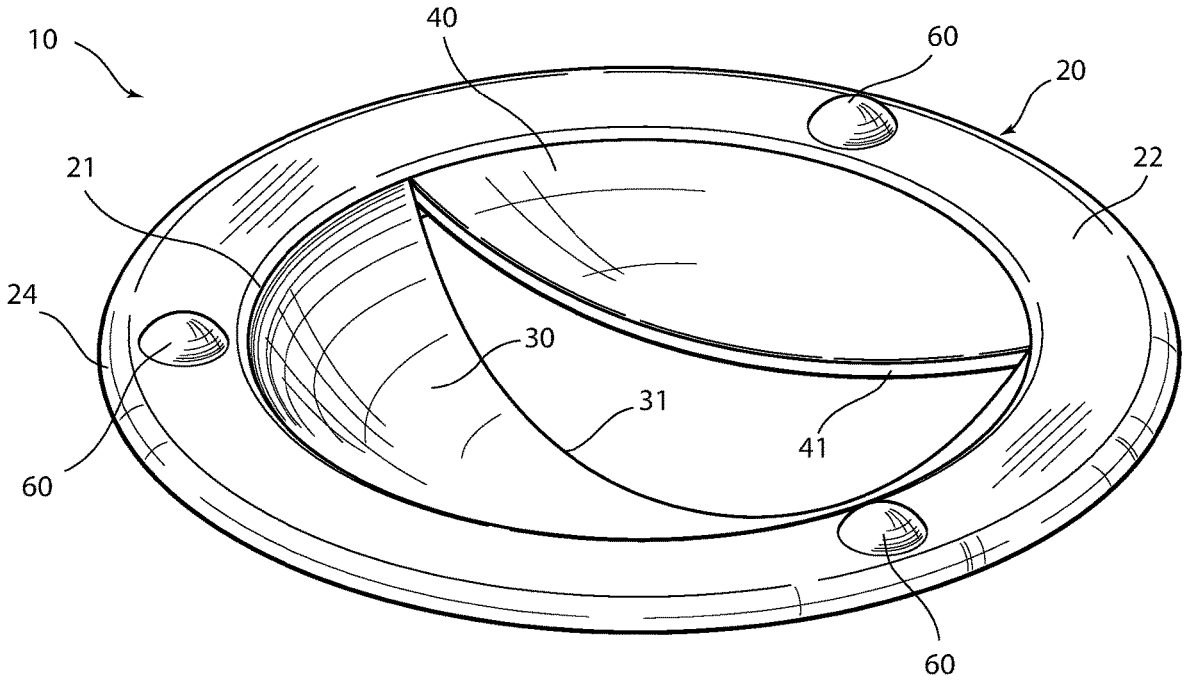
FIG. 1 is a perspective view of the top of one embodiment of a drain guard.

| | | | |
|---|---|---|---|
| 10 | first embodiment of drain guard | 20 | support ring |
| 21 | inner end of support ring | 22 | upper end of support ring |
| 23 | lower end of support ring | 24 | outer end of support ring |
| 30 | first surface | 31 | free edge of first surface |
| 40 | second surface | 41 | free edge of second surface |
| 60 | vertical protrusion | 70 | centering lip |
| 90 | sink | 91 | drain |
| 92 | drain sidewall | 93 | baffle |
| 94 | garbage disposal | 95 | utensil |
| 96 | plate | 100 | food waste |
| 10A | second embodiment of drain guard | 20A | support ring |
| 21A | inner end of support ring | 22A | upper end of support ring |
| 23A | lower end of support ring | 24A | outer end of support ring |
| 30A | first surface | 31A | first free edge of first surface |
| 31B | second free edge of first surface | 40A | second surface |
| 41A | free edge of second surface | 50A | third surface |
| 51A | free edge of third surface | 60A | vertical protrusion |
| 70A | centering lip | 10C | third embodiment of drain guard |
| 20C | support ring | 21C | inner end of support ring |
| 22C | upper end of support ring | 23C | lower end of support ring |
| 24C | outer end of support ring | 30C | first surface |
| 31C | free edge of first surface | 40C | second surface |
| 41C | free edge of second surface | 10D | fourth embodiment of drain guard |
| 20D | support ring | 21D | inner end of support ring |
| 22D | upper end of support ring | 23D | lower end of support ring |
| 24D | outer end of support ring | 30D | first surface |
| 31D | free edge of first surface | 40D | second surface |
| 41D | free edge of second surface | 60D | vertical protrusion |
| 70D | centering lip | | |

DETAILED DESCRIPTION

The term "utensil" is used herein, in a broad lay sense, to mean silverware, cutlery, chopsticks, and other similar hand-held cooking and eating instruments.

The term "dishware" is used herein, in a broad lay sense, to mean dishes, plates, bowls, platters, and other tableware.

The term "cookware" is used herein, in a broad lay sense, to mean pots, pans, casseroles, baking sheets, cutting boards, and other items used for preparing or cooking food.

The term "food waste" is used herein, in a broad lay sense, to mean food trimmings or scraps remaining on cookware, dishware, utensils, and other food-related devices and equipment after they are used for the preparation, processing, cooking, serving, eating, or storage of food.

The term "surface" is used herein, in a broad lay sense, to mean a thin layer of material with a three-dimensional shape or form.

The term "concave" is used herein, in a broad lay sense, to mean having a dish- or bowl-shaped contour.

The term "flat" is used herein, in a broad lay sense, to mean representing an exact or approximate planar orientation.

The term "annular" is used herein, in a broad lay sense, to mean representing an exact or approximate ring shape.

The term "cylindrical" is used herein, in a broad lay sense, to mean representing an exact or approximate portion of a cylinder.

The term "arcuate" is used herein, in a broad lay sense, to mean representing an exact or approximate arc in one or more planes.

First Embodiment—FIGS. 1, 2, 3, 4, 5, 6, 7, 8, 9, 10

Figure 2:
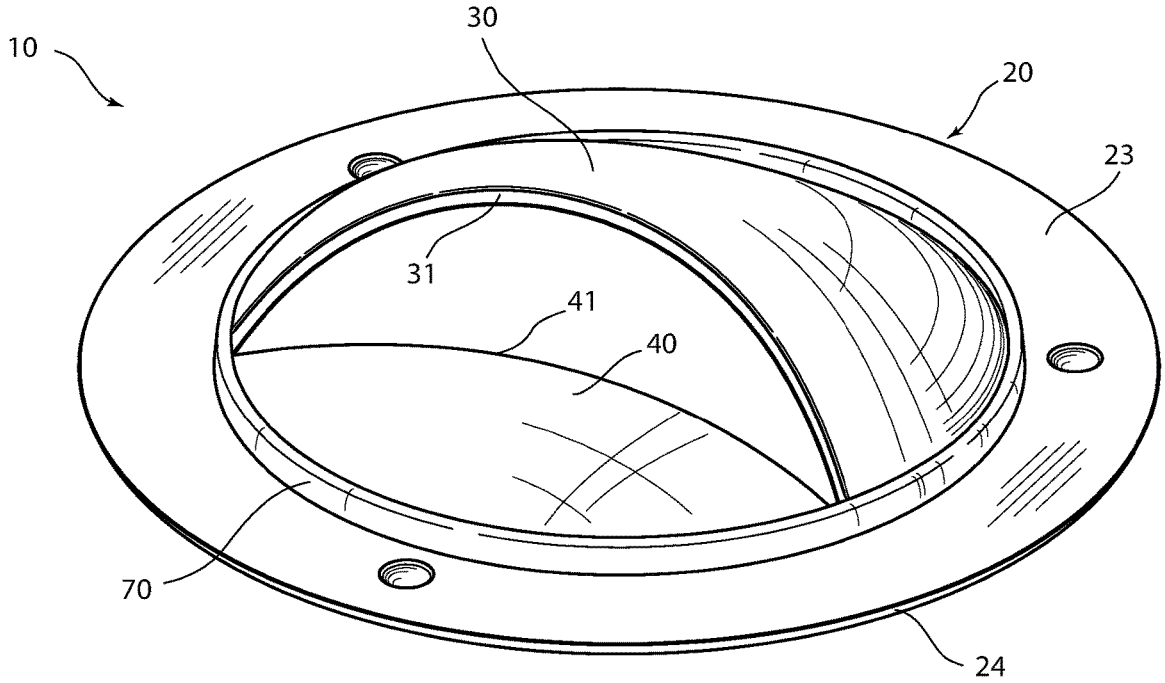
FIG. 2 is a perspective view of the bottom of the embodiment of FIG. 1.
Figure 3:
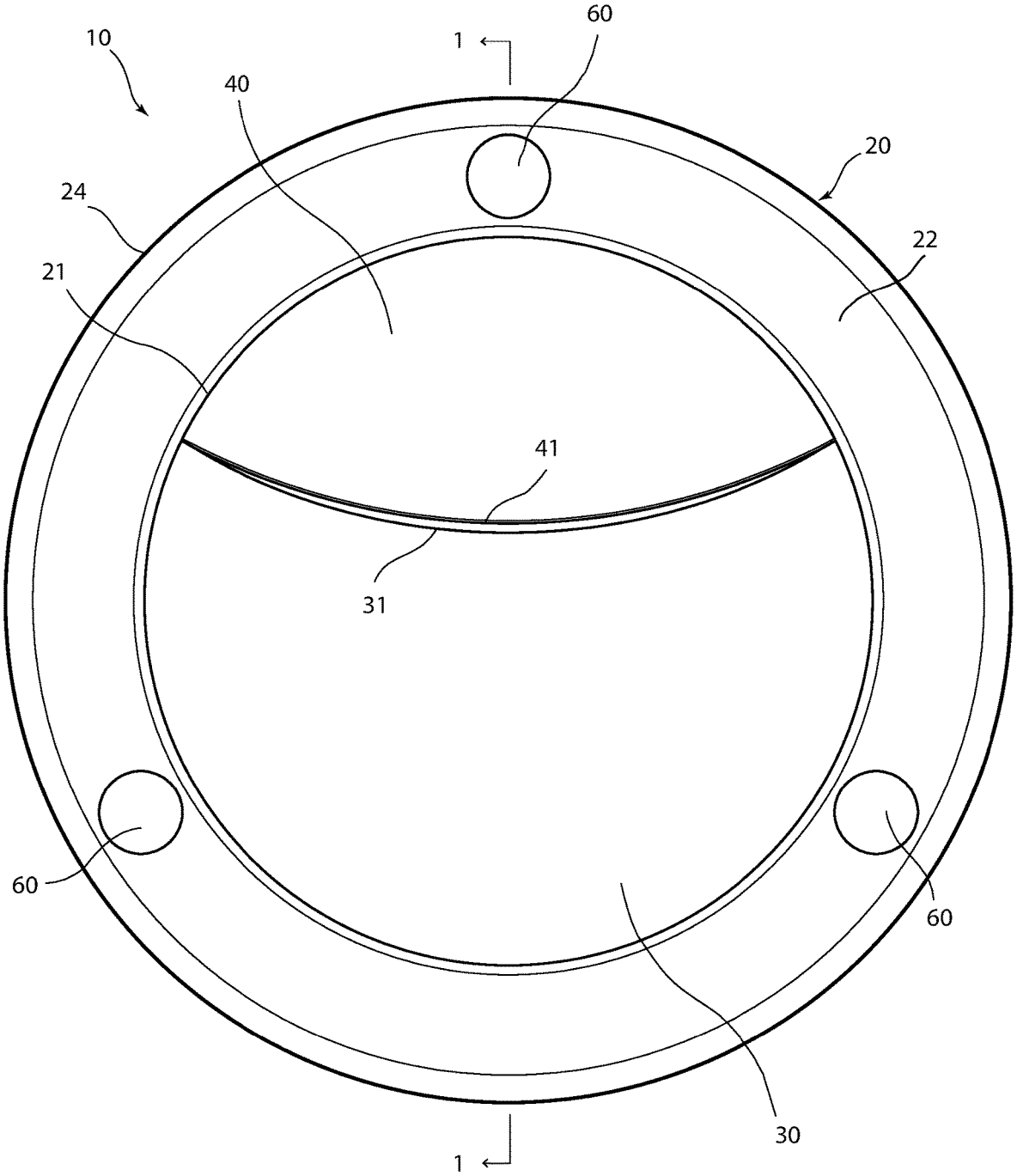
FIG. 3 is a top view of the embodiment of FIGS. 1 and 2.
Figure 4:
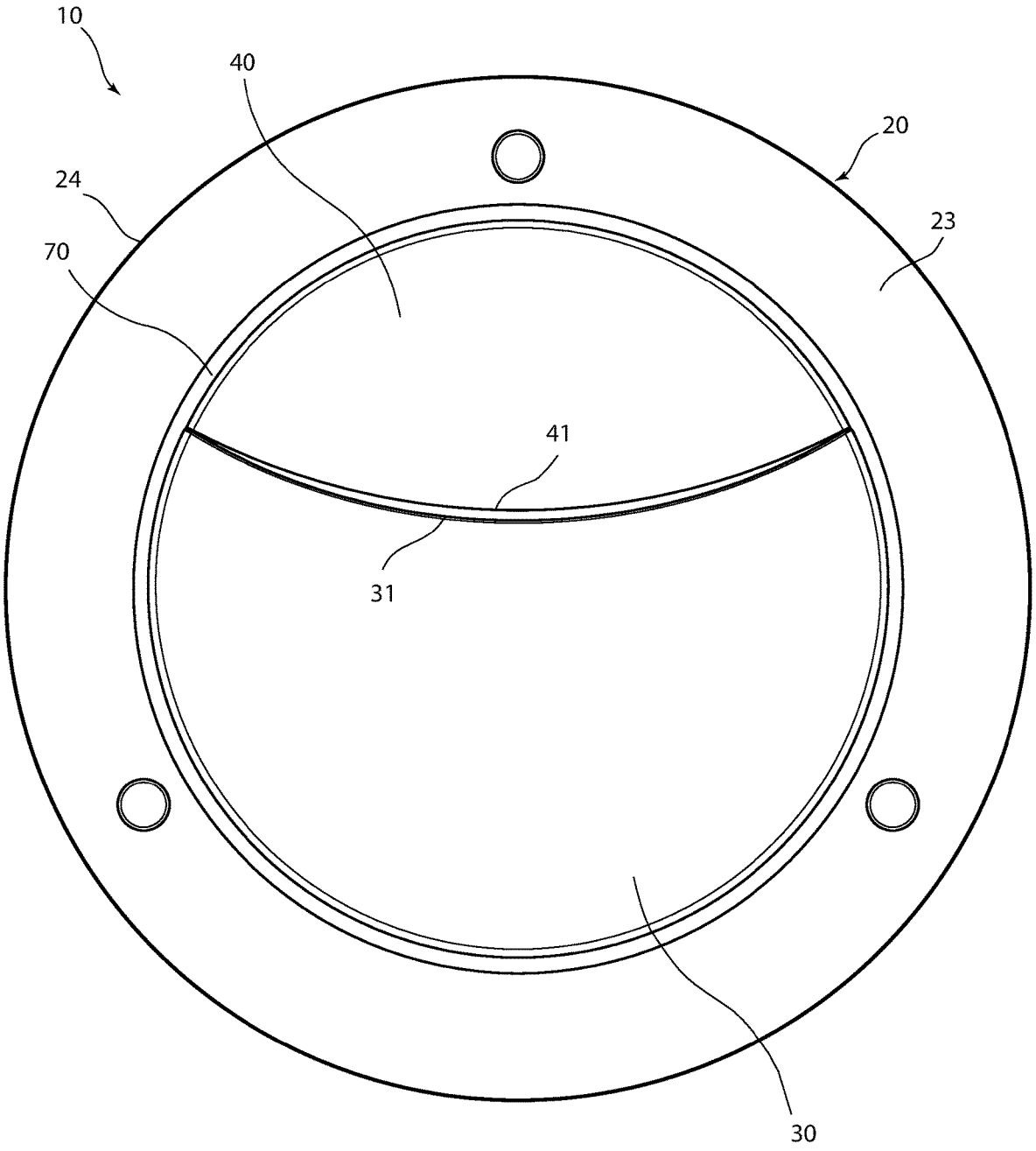
FIG. 4 is a bottom view of the embodiment of FIGS. 1-3.
Figure 5:
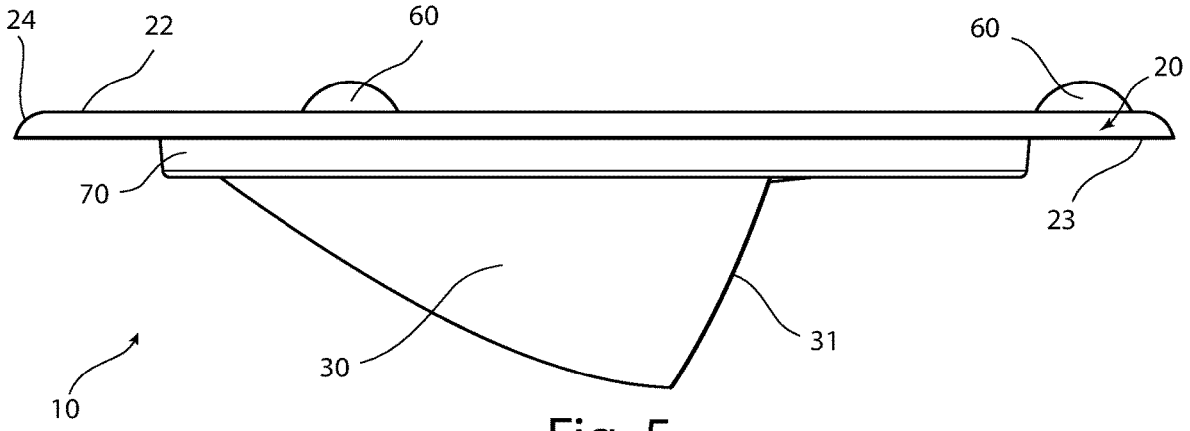
FIG. 5 is a side view of the embodiment of FIGS. 1-4.
Figure 6:
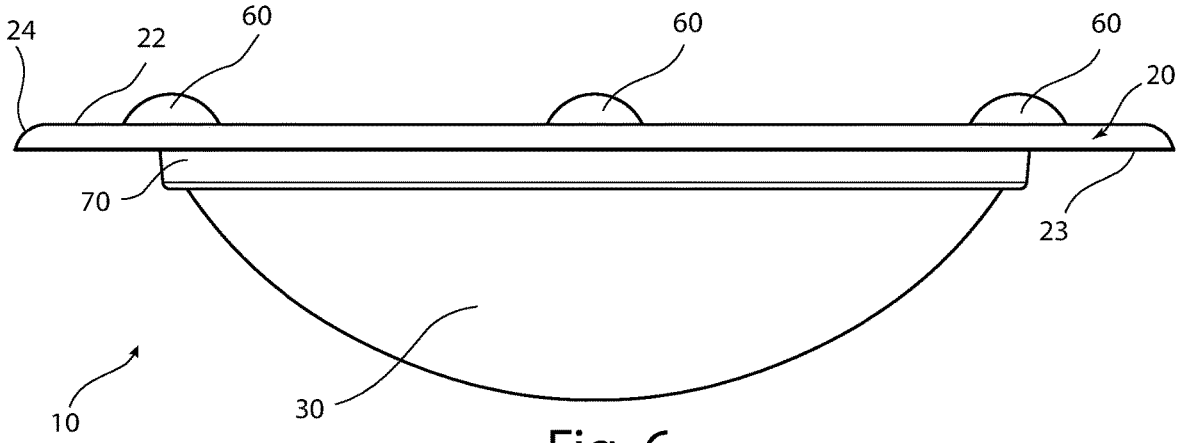
FIG. 6 is a front view of the embodiment of FIG. 1-5.
Figure 7:
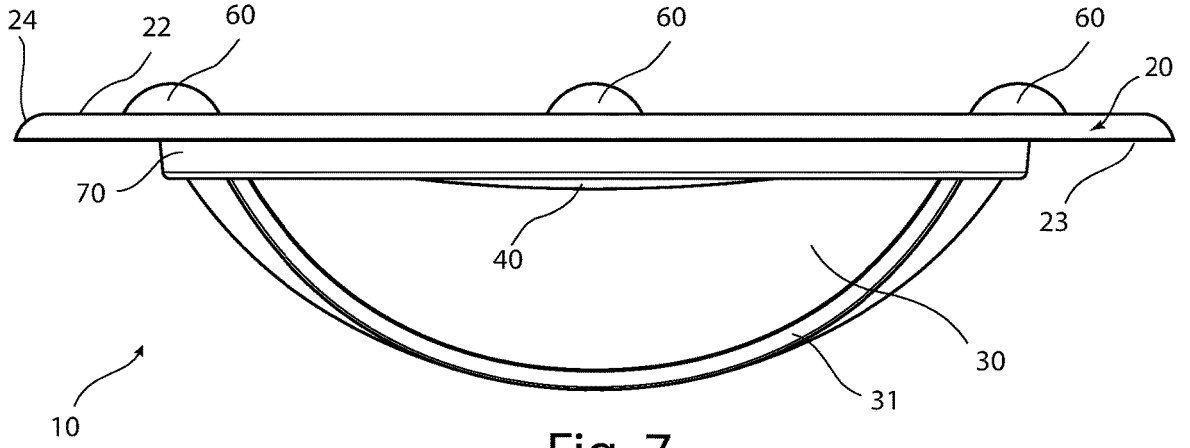
FIG. 7 is a back view of the embodiment of FIG. 1-6.
Figure 8:
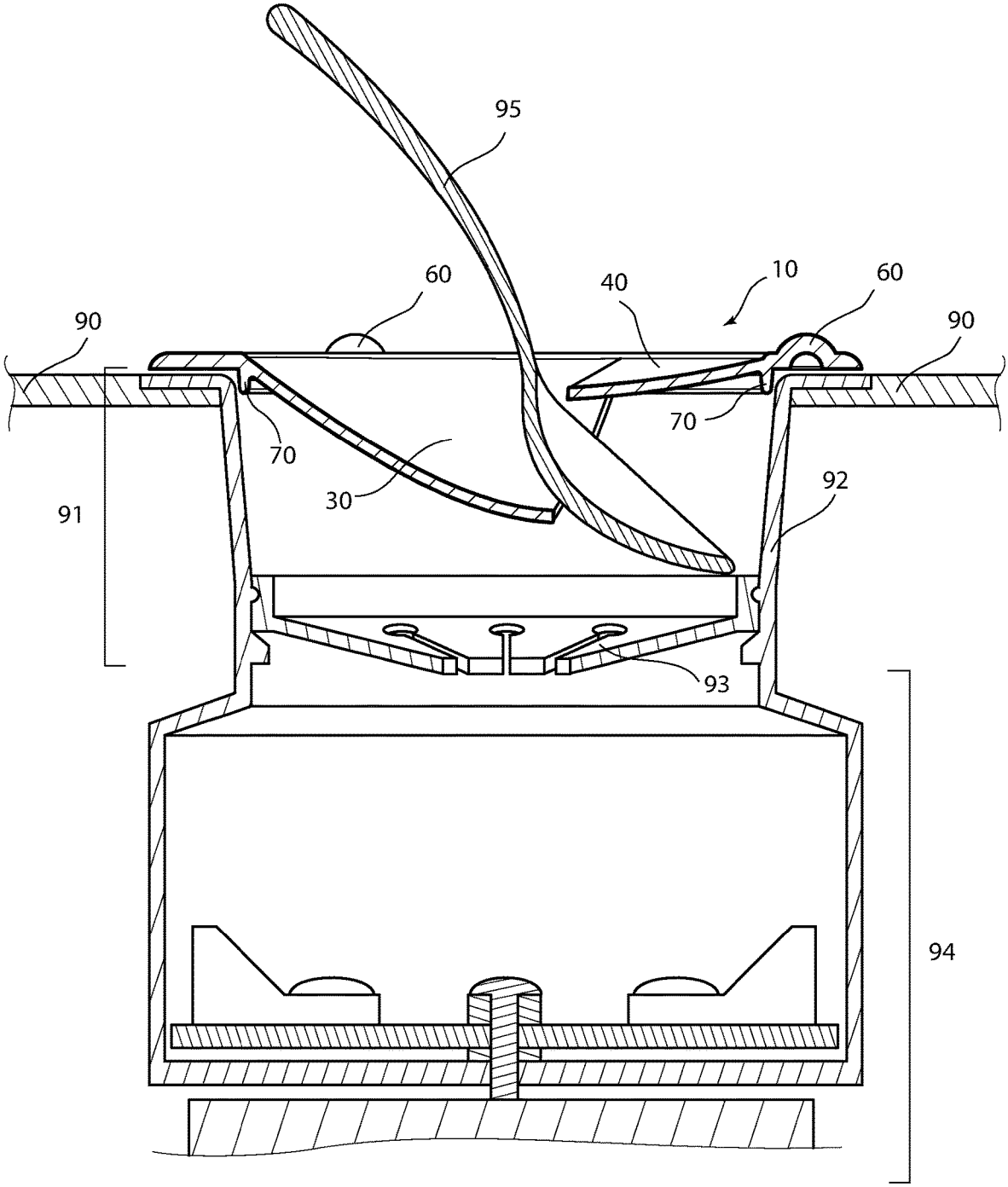
FIG. 8 is a view in detail of the portion indicated by the section lines 1-1 in FIG. 3 illustrating one embodiment of the drain guard positioned in a sink drain equipped with a garbage disposal and preventing a utensil from going into the garbage disposal.
Figure 9:
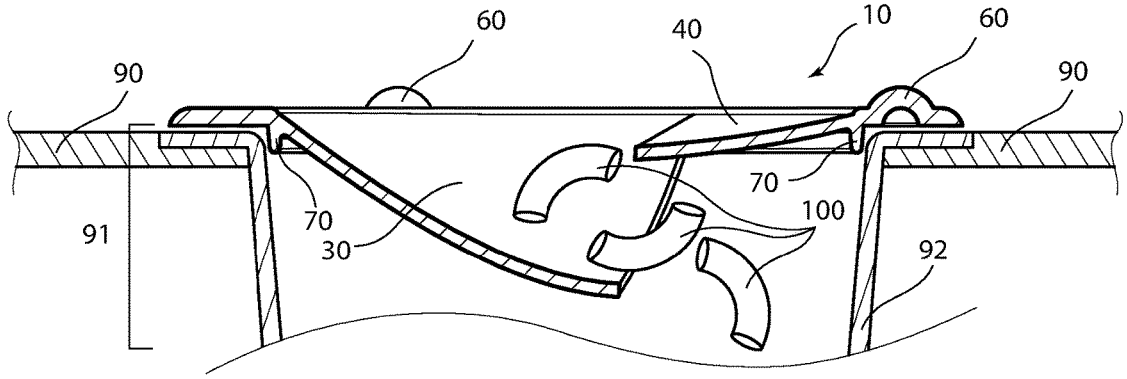
FIG. 9 is a view in detail of the portion indicated by the section lines 1-1 in FIG. 3 illustrating one embodiment of the drain guard positioned in a sink drain and allowing food waste to pass through and enter the garbage disposal.
Figure 10:
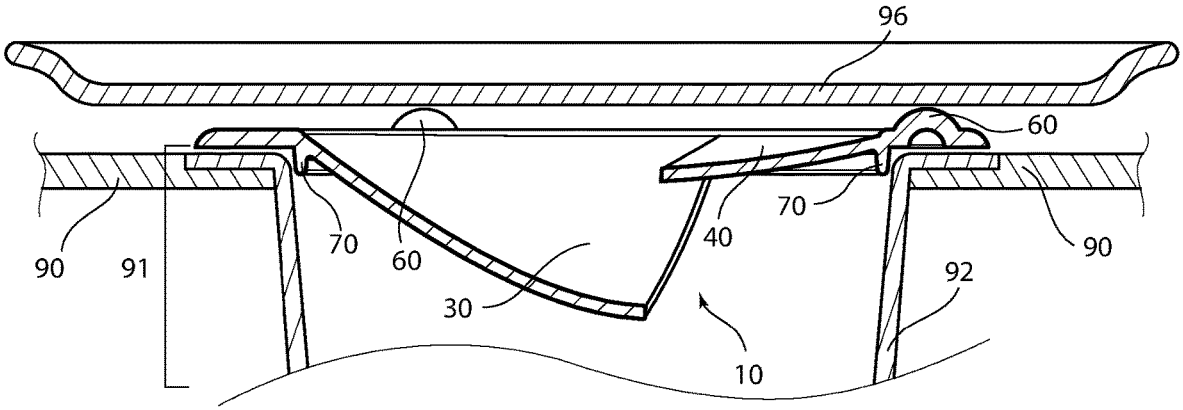
FIG. 10 is a view in detail of the portion indicated by the section lines 1-1 in FIG. 3 illustrating one embodiment of the drain guard positioned in a sink drain and preventing a dish from sealing the drain.

FIGS. 1-2 (perspective views of first embodiment of drain guard), FIGS. 3-7 (orthogonal views of first embodiment of drain guard), and FIGS. 8-10 (cross-sectional views of first embodiment of drain guard) show one embodiment of a sink strainer or drain cover or drain guard 10 comprising a support ring 20 having an outer end or perimeter 24, an inner end or perimeter 21, a top or upper end 22, a bottom or lower end 23, and a first interior surface 30 and a second interior surface 40 partially extending inward or centrally from different or separate segments or portions of support ring 20. First surface 30 terminates internal of support ring 20 and has a free edge 31, and second surface 40 terminates internal of support ring 20 and has a free edge 41. Surfaces 30 and 40 are configured such that free edges 31 and 41 are generally in close lateral or horizontal proximity or are laterally or horizontally adjacent along at least the majority of their lengths but are separated or offset or spaced by a vertical distance. When positioned at a drain 91 of a sink 90 equipped with a garbage disposal 94, drain guard 10 works in conjunction with a drain sidewall 92 and a baffle 93 to allow water and food waste 100 to pass through but prevent a utensil 95 or other larger objects from entering garbage disposal 94.

Drain guard 10 works by creating a complex path for objects to travel in order to reach garbage disposal 94. Food waste 100 and other objects must first pass between free edges 31 and 41, at which point it moves towards either the drain sidewall 92 or baffle 93. The food waste 100 must then change direction away from the drain sidewall 92 in order to pass through the hole or opening at the center of baffle 93. This complex path may allow most food waste 100 to pass through but prevents larger and longer objects such as utensil 95 from being able to pass through into garbage disposal 94. In order to pass between free edges 31 and 41, utensil 95 will generally be forced into an angled or flat orientation as opposed to a vertical orientation. The angled or flat orientation of utensil 95 means that its trajectory is in the direction of the drain sidewall 92 or baffle 93. Due to the size, shape, and length of utensil 95, drain guard 10 may effectively prevent utensil 95 from reorienting vertically or inverting its orientation, which may stop it from passing through the opening at the center of baffle 93 into garbage disposal 94. Generally, the vertical distance between free edges 31 and 41 across the width of the drain guard 10, the shapes and positions of free edges 31 and 41, the shapes of surfaces 30 and 40, along with the configuration of the drain sidewall 92 and baffle 93 will determine what sizes and shapes of food waste 100, utensil 95, and other objects will pass through or be prevented from passing through.

Still referring to FIGS. 1-10, in some embodiments, one or more of surfaces 30 and 40 may be downwardly sloped in shape or contour to facilitate the channeling and flow of water and food waste 100 between free edges 31 and 41 and down drain 91 into garbage disposal 94. In some embodiments, one or more of surfaces 30 and 40 may be concave in shape, but in other embodiments, one or more of surfaces 30 and 40 may be generally stepped, conical, convex, or otherwise appropriately sloped. In addition to directing water and food waste 100 into garbage disposal 94, surfaces 30 and 40 may also serve as barriers to prevent larger objects such as utensil 95 from easily going down drain 91 and into garbage disposal 94. Additionally, surfaces 30 and 40 may also block or reduce noise emitted from garbage disposal 94 when it is activated. Surfaces 30 and 40 may also serve as barriers to prevent water or food waste 100 from accidently being ejected upward from garbage disposal 94 toward the user or operator. In some embodiments, surfaces 30 and 40 may be generally solid without any perforations so that water and food waste 100 is entirely channeled between free edges 31 and 41 and down drain 91 into garbage disposal 94, water continues to flow and flush down any food waste 100 that may be between free edges 31 and 41 or on baffle 93, smaller food waste 100 does not get trapped in or clog such perforations, and drain guard 10 is easier to keep clean, but in other embodiments, one or more of surfaces 30 and 40 may partially or entirely have perforations, slots, grooves, ridges, or other functional or ornamental features.

In some embodiments, free edges 31 and 41 may be approximately horizontally or laterally aligned such that the vertical projections, or the orthogonal projections onto the horizontal plane, of the free edges are approximately congruent or coinciding with a minimal or negligible spacing or gap in order to provide for simpler and lower-cost manufacturing by eliminating overhangs but still allowing for slight mold or tooling draft angles, such as for stamping, forming, and molding processes, while still preventing utensil 95 or other objects from entering garbage disposal 94 by preventing its vertical orientation and directing it towards the drain sidewall 92 or the baffle 93. In other embodiments, free edges 31 and 41 may be generally laterally overlapped, potentially increasing manufacturing cost and complexity due to overhangs, in order to improve the ability of drain guard 10 to prevent utensil 95 or other objects from entering the garbage disposal 94 by further forcing utensil 95 to have a more horizontal orientation and directing it further towards drain sidewall 92 and away from center of baffle 93. In yet other embodiments, free edges 31 and 41 may not overlap and generally be moderately or slightly laterally offset or spaced by no more than approximately 0.25 inches to decrease manufacturing cost and complexity by allowing for simpler molds or tooling, but with diminished ability of drain guard 10 to prevent utensil 95 or other objects from entering the garbage disposal 94 by allowing utensil 95 to have a more vertical orientation.

Still referring to FIGS. 1-10, in some embodiments, the maximum vertical distance between free edges 31 and 41 may be between approximately 0.5 inch to 1 inch to allow larger food waste 100 such as pasta and strawberry stems to pass through, but in other embodiments, the maximum vertical distance may be larger or smaller. A larger vertical distance may allow even larger particles to pass through but may make it easier for a utensil 95 or other objects to enter garbage disposal 94. On the other hand, a smaller vertical distance may make it more difficult for a utensil 95 or other objects to enter garbage disposal 94 but may also prevent moderately sized food particles from passing through. Depending on the configurations and shapes of surfaces 30 and 40, the vertical distance between free edges 31 and 41 may vary across the width of drain guard 10 from effectively zero (if and where surfaces 30 and 40 meet at their interface with support ring 20) to the maximum vertical distance, which may be at or near the midpoints of free edges 31 and 41.

In some embodiments, one or more of free edges 31 and 41 may be generally arcuate or curved in one or more planes to increase the area through which food waste 100 may pass, but in other embodiments, one or more of free edges 31 and 41 may be straight, angled, jagged, or otherwise shaped. In some embodiments, one or more of free edges 31 and 41 may be positioned generally laterally offset from the center of drain guard 10 so as to further direct utensil 95 or other objects towards drain sidewall 92 and away from the center of baffle 93 in order to improve the ability of drain guard 10 to prevent utensil 95 or other objects from entering the garbage disposal 94.

In further detail, still referring to FIGS. 1-10, support ring 20 may be appropriately sized and configured to position drain guard 10 at the entrance to drain 91. In some embodiments, support ring 20 may be configured to rest on top of the upper portion of drain 91 or at the bottom of sink 90 near the opening for drain 91, but in other embodiments, support ring 20 may fit inside of drain 91 instead of on top of it. In some embodiments, support ring 20 may be generally shaped like an annular disk and have a generally flat lower end 23 and a generally flat upper end 22 to create a better seal between support ring 20 and sink 90 or drain 91 and to allow water and food waste 100 to more easily flow over support ring 20 and between free edges 31 and 41 into drain 91. In other embodiments, support ring 20 may be generally cylindrical in shape to fit inside of drain 91. In yet other embodiments, support ring 20 may be discontinuous such that it has the general shape of a ring but with one or more sections of the ring removed. In some embodiments, inner perimeter 21 of support ring 20 may be sized with a diameter of between approximately 3.25 inches and 3.375 inches to correspond to the inner diameter of drain sidewall 92 for a standard kitchen sink garbage disposal drain. In some embodiments, inner perimeter 21 and outer perimeter 24 of support ring 20 may have a generally circular shape or form to match the shape of the drain 91 in which it is used, but in other embodiments, they may represent another suitable geometric, organic, or decorative shape. In some embodiments, upper end 22 and lower end 23 of support ring 20 may have other features or elements, such as suction cups, channels, protrusions, or decorative elements. In some embodiments, outer perimeter 24 of support ring 20 may be tapered, chamfered, radiused, beveled, or otherwise formed to facilitate the flow of water and food waste 100 from the bottom of sink 90 over support ring 20 and through free edges 31 and 41 into drain 91.

In some embodiments, drain guard 10 may entirely or partially be made of an elastomeric material such as silicone, rubber, or thermoplastic elastomer to allow for low-cost manufacturing and a flexible form that can easily conform to sink drain 91, resist sliding, be easy to clean, have soft-touch characteristics, and withstand temperatures up to approximately 100 degrees C. without warping, such as for being dishwasher safe or contacting boiling water, but in other embodiments, other materials or combinations of materials can be used, such as plastic, metal, composite, or any other suitable material. In some embodiments, drain guard 10 may be entirely or partially manufactured using an injection molding process to reduce manufacturing costs and production time, but in other embodiments, other manufacturing processes or combinations of processes such as stamping, punching, forming, compression molding, machining, and additive manufacturing may be used. In some embodiments, the elastomeric material may generally be between approximately 0.625 and 0.125 inch thick and may have a hardness between approximately 65 A and 95 A to provide adequate durability and sufficient stiffness to maintain its form and help prevent utensil 95 or other objects from passing through free edges 31 and 41 by resisting deformation and grabbing utensil 95 or other objects, but in other embodiments, other thicknesses and hardnesses may be used.

Still referring to FIGS. 1-10, in some embodiments, drain guard 10 may have one or more upward extending vertical protrusion 60 that may help to prevent a plate 96 or other dishware or cookware from completely or partially sealing drain 91 or otherwise impeding the drainage of water into drain 91 by at least partially raising plate 96 or other dishware or cookware off of the bottom of sink 90 or above support ring 20 in order to provide a gap that allows water to enter drain 91. In some embodiments, vertical protrusion 60 may be positioned on upper end 22 of support ring 20, but in other embodiments, vertical protrusion 60 may be positioned on other elements of drain guard 10 such as one or more of surfaces 30 and 40. In some embodiments, vertical protrusion 60 may be hemispherical, but in other embodiments, a conical, cylindrical, geometric, prismatic, ridge, organic, or any other suitable shape may be used. In some embodiments, vertical protrusion 60 may extend at least approximately 0.1 inches above upper end 22 to create a sufficient gap between upper end 22 and plate 96 or other dishware or cookware so as to prevent sink 90 from filling up with water by creating a path or paths between plate 96 and upper end 22 or sink 90 for water to flow into drain 91 approximately at or above the water flow rate of a faucet when plate 96 or other dishware or cookware is placed over drain 91, but in other embodiments, taller or shorter protrusion heights may be used with increased or decreased water flow ability, respectively. Depending on its position(s) on support ring 20, a single vertical protrusion 60 may require a taller height than two vertical protrusions 60 to allow a similar flow rate because two vertical protrusions 60 positioned farther apart may create a larger gap between upper end 22 and plate 96 and, therefore, a larger total area through which water can flow into drain 91. Similarly, three or more vertical protrusions 60 may require less height than two vertical protrusions 60 because three or more vertical protrusions 60 will generally position plate 96 in a flat or level orientation and may create a more consistent gap between plate 96 and upper end 22 along inner perimeter 21, whereas one or two vertical protrusions 60 will generally position plate 96 in an angled or tilted orientation, which depending on their positions on support ring 20 may result in a reduced gap between plate 96 and upper end 22 at positions along inner perimeter 21 that are farther from the vertical protrusion(s) 60. Generally, taller or higher vertical protrusions 60 will more easily allow water and small food waste 100 to pass between plate 96 and upper end 22 when plate 96 is positioned above upper end 22, particularly when plate 96 has a bottom that is not flat, or when the weight of plate 96 and the items above it cause some compression of vertical protrusion(s) 60, or when food waste 100 or other objects obstruct the flow of water between plate 96 and upper end 22 and into drain 91.

Still referring to FIGS. 1-10, in some embodiments, drain guard 10 may have a downward extending centering lip 70 that may help to keep drain guard 10 approximately centrally positioned with respect to drain 91 by engaging with drain sidewall 92 and generally preventing drain guard 10 from laterally shifting position. In some embodiments, centering lip 70 may be positioned on lower end 23 of support ring 20, but in other embodiments, centering lip 70 may be positioned on other elements of drain guard 10 such as the bottom of one or more of surfaces 30 and 40. In some embodiments, centering lip 70 may be a continuous ring-shaped lip, but in other embodiments, centering lip 70 may be one or more continuous or discontinuous protrusions or similar feature or features that generally prevents drain guard 10 from laterally shifting position. In some embodiments, centering lip 70 may be sized with an outer diameter of between approximately 3.25 inches and 3.375 inches or be configured with a radial position of between approximately 1.625 inches and 1.6875 inches with respect to the center of support ring 20 to reasonably engage with drain sidewall 92 for a standard kitchen sink garbage disposal drain.

Figure 11:
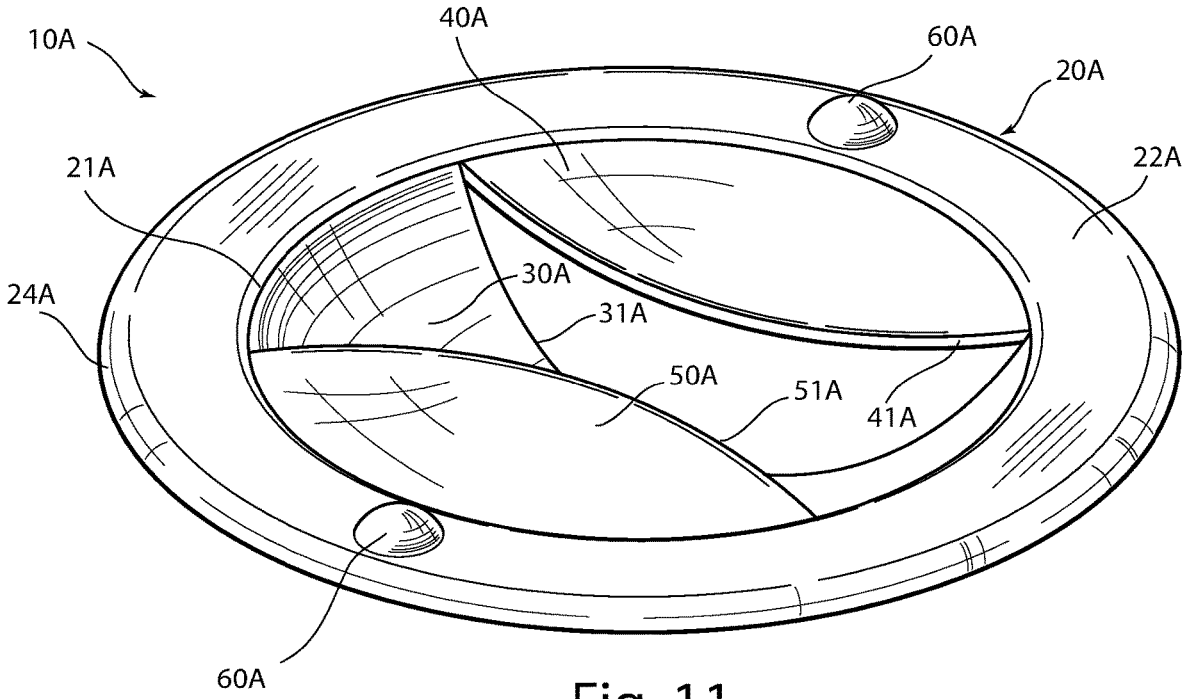
FIG. 11 is a perspective view of the top of a second embodiment of a drain guard.
Figure 12:
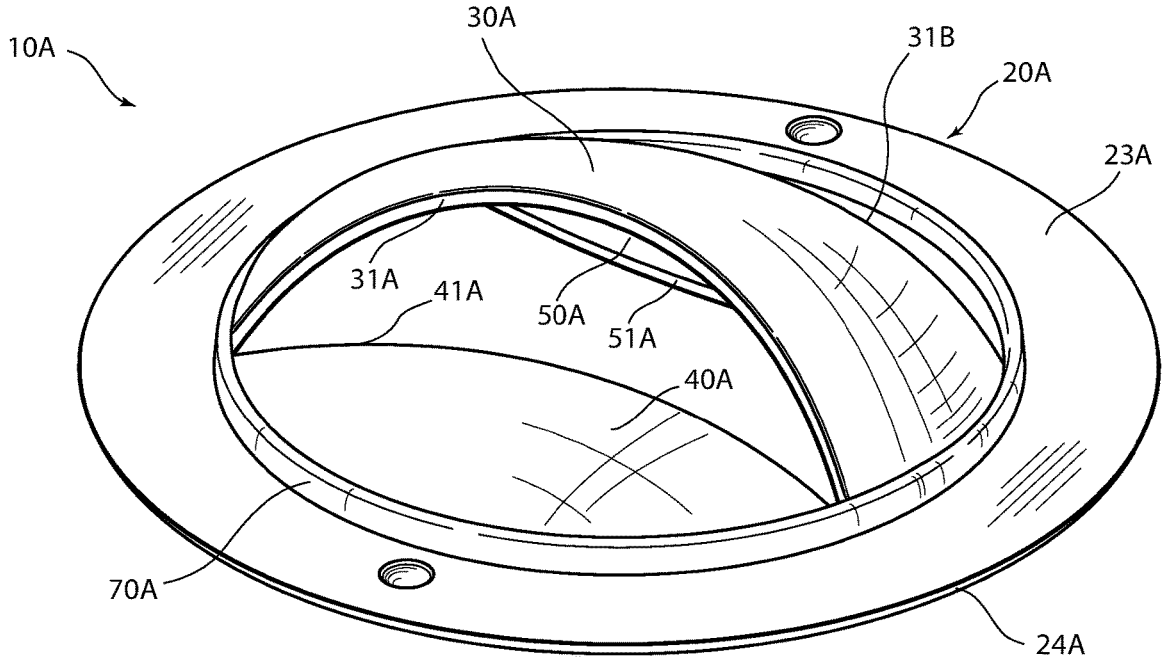
FIG. 12 is a perspective view of the bottom of the embodiment of FIG. 11.

Second Embodiment—FIGS. 11, 12

FIGS. 11-12 (perspective views of second embodiment of drain guard) show another embodiment of a drain guard 10A comprising a support ring 20A having an outer perimeter 24A, an inner perimeter 21A, an upper end 22A, a lower end 23A, and a first surface 30A, a second surface 40A, and a third surface 50A extending inward from different portions of support ring 20A. First surface 30A terminates internal of support ring 20A and has a first free edge 31A and a second free edge 31B, second surface 40A terminates internal of support ring 20A and has a free edge 41A, and third surface 50A terminates internal of support ring 20A and has a free edge 51A. Surfaces 30A, 40A, and 50A are configured such that free edges 31A and 41A and free edges 31B and 51A are generally in close horizontal or lateral proximity but are separated by a vertical distance, respectively.

In some embodiments, drain guard 10A may have one or more upward extending vertical protrusion 60A. In some embodiments, vertical protrusion 60A may be positioned on upper end 22A of support ring 20A, but in other embodiments, vertical protrusion 60A may be positioned on other elements of drain guard 10A such as one or more of surfaces 30A and 40A.

In some embodiments, drain guard 10A may have a downward extending centering lip 70A that may help to keep drain guard 10A approximately centrally positioned and may generally prevent drain guard 10A from laterally shifting position. In some embodiments, centering lip 70A may be positioned on lower end 23A of support ring 20A, but in other embodiments, centering lip 70A may be positioned on other elements of drain guard 10A such as the bottom of one or more of surfaces 30A and 40A.

Figure 13:
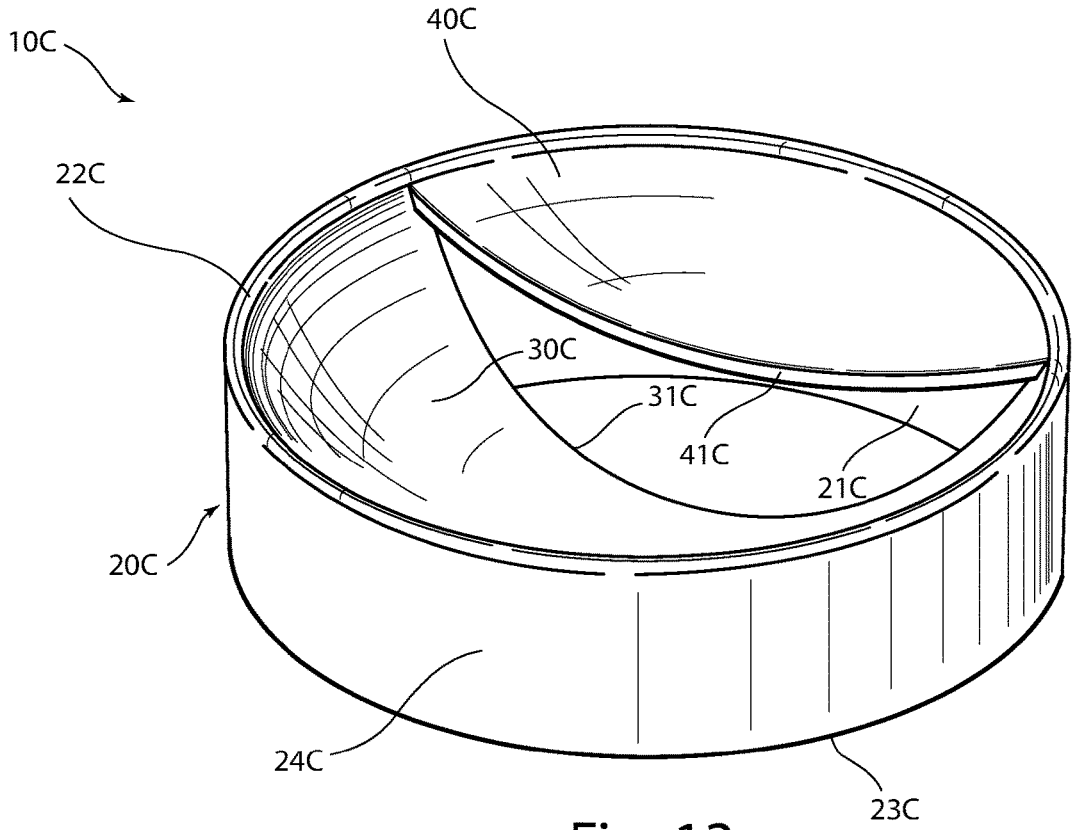
FIG. 13 is a perspective view of the top of a third embodiment of a drain guard.
Figure 14:
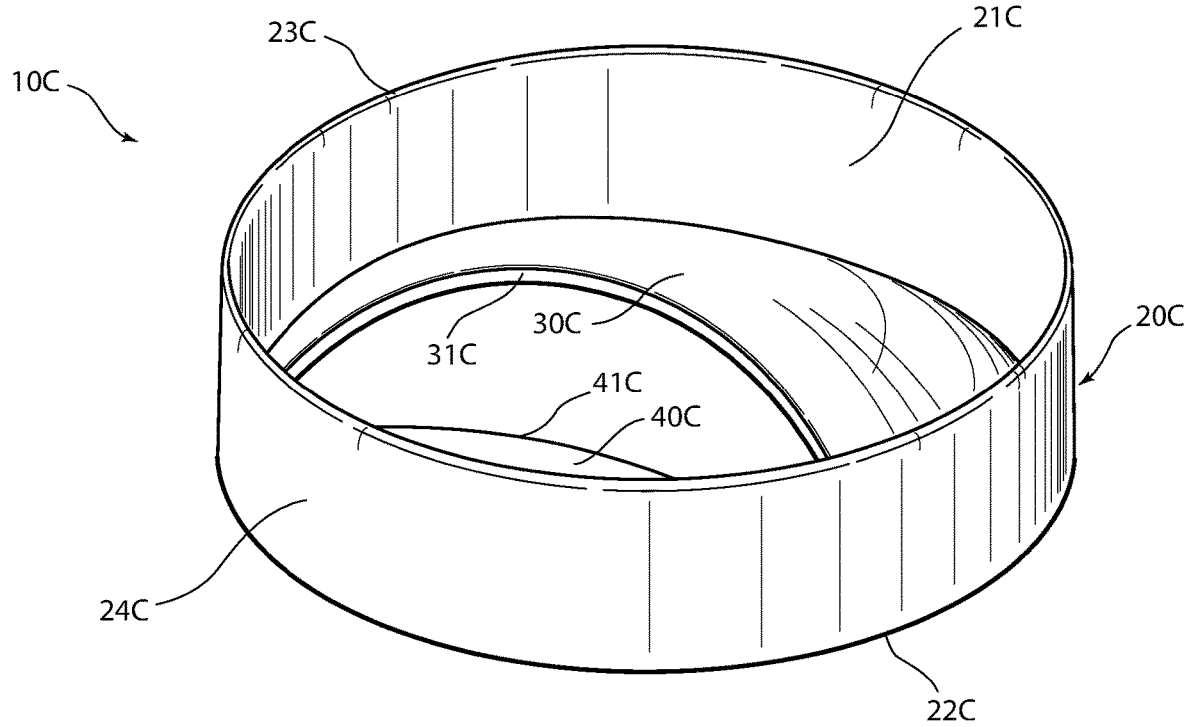
FIG. 14 is a perspective view of the bottom of the embodiment of FIG. 13.

Third Embodiment—FIGS. 13, 14

FIGS. 13-14 (perspective views of third embodiment of drain guard) show another embodiment of a drain guard 10C comprising a support ring 20C having an outer perimeter 24C, an inner perimeter 21C, an upper end 22C, a lower end 23C, and a first surface 30C and a second surface 40C partially extending inward from generally different portions of support ring 20C. First surface 30C terminates internal of support ring 20C and has a free edge 31C, and second surface 40C terminates internal of support ring 20C and has a free edge 41C. Surfaces 30C and 40C are configured such that free edges 31C and 41C are generally in close horizontal or lateral proximity but are separated by a vertical distance. In some embodiments, free edges 31C and 41C may be generally laterally overlapped.

Figure 15:
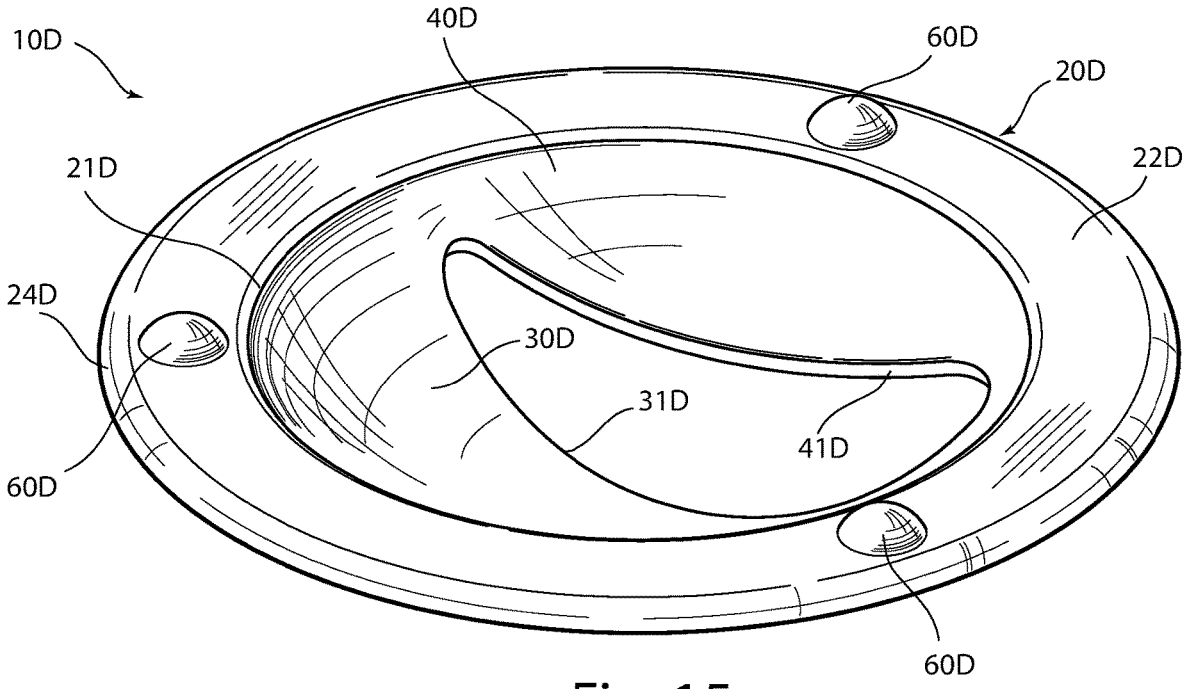
FIG. 15 is a perspective view of the top of a fourth embodiment of a drain guard.
Figure 16:
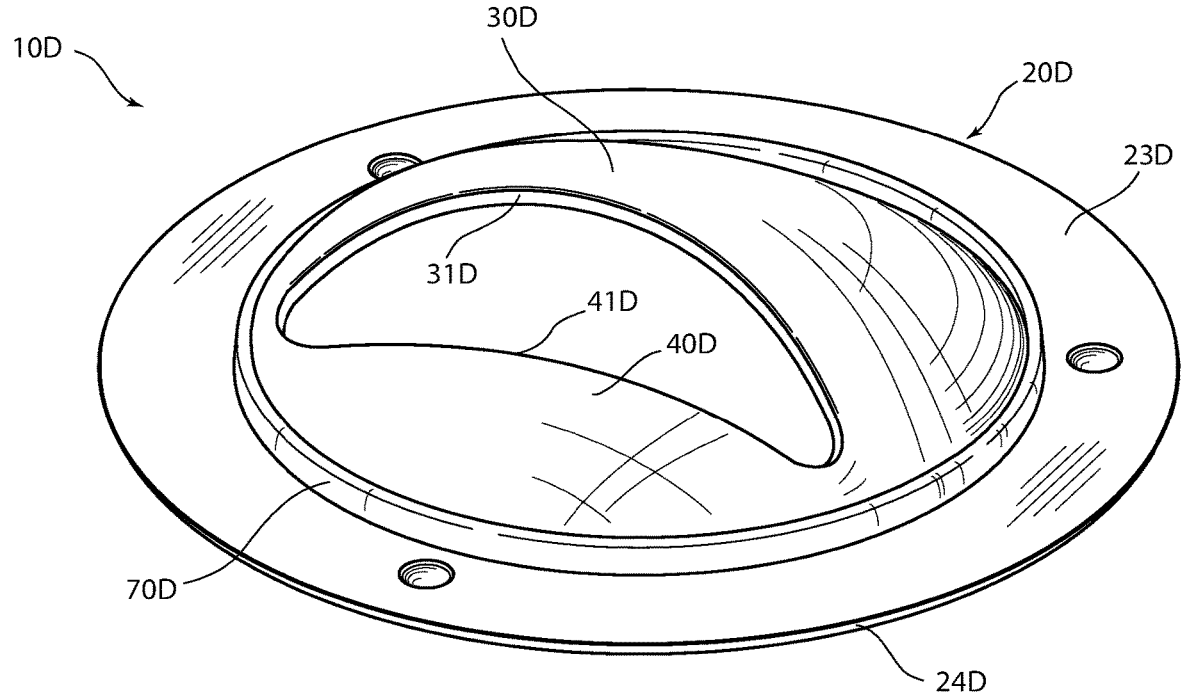
FIG. 16 is a perspective view of the bottom of the embodiment of FIG. 15.

Fourth Embodiment—FIGS. 15, 16

FIGS. 15-16 (perspective views of fourth embodiment of drain guard) show another embodiment of a drain guard 10D comprising a support ring 20D having an outer perimeter 24D, an inner perimeter 21D, an upper end 22D, a lower end 23D, and a first surface 30D and a second surface 40D extending inward from support ring 20D. First surface 30D terminates internal of support ring 20D and has a free edge 31D, and second surface 40D terminates internal of support ring 20D and has a free edge 41D. Surfaces 30D and 40D are configured such that free edges 31D and 41D are generally in close horizontal or lateral proximity but are separated by a vertical distance. In some embodiments, surfaces 30D and 40D may be physically connected in some relatively small portions but are generally disposed or arranged in separate and distinct areas interior of support ring 20D such that they effectively behave as two disparate or incongruent surfaces.

In some embodiments, drain guard 10D may have one or more upward extending vertical protrusion 60D. In some embodiments, vertical protrusion 60D may be positioned on upper end 22D of support ring 20D, but in other embodiments, vertical protrusion 60D may be positioned on other elements of drain guard 10D such as one or more of surfaces 30D and 40D.

In some embodiments, drain guard 10D may have a downward extending centering lip 70D that may help to keep drain guard 10D approximately centrally positioned and may generally prevent drain guard 10D from laterally shifting position. In some embodiments, centering lip 70D may be positioned on lower end 23D of support ring 20D, but in other embodiments, centering lip 70D may be positioned on other elements of drain guard 10D such as the bottom of one or more of surfaces 30D and 40D.

Advantages

From the description above and accompanying drawings, a number of advantages of one or more aspects of our drain guard become evident. Our garbage disposal drain guard allows a variety of food waste particle sizes to pass through into the garbage disposal but effectively prevents utensils and other larger objects from entering the garbage disposal. Our drain guard helps reduce noise from the garbage disposal during operation. Our drain guard protects the user from splashing or food ejection from the garbage disposal. Our drain guard is easy to clean. Our drain guard is made of materials that can withstand temperatures up to approximately 100 C without warping. Our drain guard is of simple construction to allow for cost-effective manufacturing. Our drain guard can allow water to drain from the sink even if covered by dishware or cookware. Our drain guard can stay centered on the drain without shifting.

CONCLUSION AND SCOPE

Accordingly, the reader will see that the various embodiments of the drain guard can adequately allow a variety of food waste particles to pass through, can prevent utensils and other objects from entering the garbage disposal, and is of simple construction.

While the foregoing written description of the embodiments enables one of ordinary skill to make and use what is considered presently to be the best mode thereof, those of ordinary skill will understand and appreciate the existence of variations, combinations, and equivalents of the specific embodiments, methods, and examples herein. The invention should therefore not be limited by the above described embodiments, methods, and examples, but by all embodiments and methods within the scope and spirit of the invention as claimed.

What is claimed is:

1. A drain guard for a sink having a drain equipped with a garbage disposal, wherein the garbage disposal receives through the drain liquid and food waste to be disposed of by the garbage disposal, the drain guard comprising:

a support ring having an outer end, an inner end, an upper end, and a lower end;

a plurality of disparate interior surfaces extending inwardly from different portions of the support ring;

wherein at least one of the interior surfaces has a downward sloping contour;

wherein the interior surfaces terminate internal of the support ring such that the interior surfaces have free edges;

wherein at least one pair of free edges are laterally proximate;

wherein the laterally proximate free edges are generally separated by a vertical distance;

whereby the drain guard can be positioned at the drain of the sink such that the drain guard allows liquid and food waste to pass between the free edges of the interior surfaces and prevents utensils and other large objects from entering the garbage disposal.

2. The drain guard as in claim 1, wherein the support ring is an annular disk.

3. The drain guard as in claim 1, wherein at least one of the interior surfaces is concave in shape.

4. The drain guard as in claim 1, wherein at least one pair of free edges are approximately laterally aligned.

5. The drain guard as in claim 1, wherein at least one free edge is arcuate.

6. The drain guard as in claim 1, wherein the free edges are positioned laterally offset from a center of the drain guard.

7. The drain guard as in claim 1, wherein the maximum vertical distance between the laterally proximate free edges is at least approximately 0.5 inches.

8. The drain guard as in claim 1 further comprising at least one vertical protrusion extending at least approximately 0.1 inches above the upper end of the support ring.

9. The drain guard as in claim 1 further comprising a downwardly extending centering lip that engages with a sidewall of the drain.

10. The drain guard as in claim 1, wherein the drain guard is at least partially made of an elastomeric material.

11. A drain cover for a sink drain equipped with a garbage disposal, wherein the garbage disposal receives through the sink drain liquid and food waste to be disposed of by the garbage disposal, the drain cover comprising:

a support ring having an inner perimeter, an outer perimeter, a top end, and a bottom end;

a plurality of incongruent interior surfaces extending centrally from separate segments of the support ring;

wherein at least one of the interior surfaces has a downward sloping shape;

wherein the interior surfaces terminate internal of the support ring such that the interior surfaces have free edges;

wherein at least one pair of free edges are horizontally adjacent;

wherein the horizontally adjacent free edges are generally vertically offset;

whereby the drain cover can be placed at the sink drain such that the drain cover allows food waste particles to pass between the interior surfaces and prevents utensils and other objects from entering the garbage disposal.

12. The drain cover as in claim 11, wherein the support ring is an annular disk.

13. The drain cover as in claim 11, wherein at least one of the interior surfaces is concave in shape.

14. The drain cover as in claim 11, wherein at least one pair of free edges are approximately horizontally aligned.

15. The drain cover as in claim 11, wherein at least one free edge is arcuate.

16. The drain cover as in claim 11, wherein the free edges are disposed horizontally offset from a center of the drain cover.

17. The drain cover as in claim 11, wherein the maximum vertical distance between the horizontally adjacent free edges is at least approximately 0.5 inches.

18. The drain cover as in claim 11 further comprising at least one vertical protrusion extending at least approximately 0.1 inches above the top end of the support ring.

19. The drain cover as in claim 11 further comprising a downwardly extending centering lip that engages with a sidewall of the drain.

20. The drain cover as in claim 11, wherein the drain cover is at least partially made of an elastomeric material.

* * * * *